US005913669A

United States Patent [19]

Hansen et al.

[11] Patent Number: 5,913,669

[45] Date of Patent: Jun. 22, 1999

[54] AIMING LIGHT MOUNT AND SYSTEM FOR SHOTGUN

[75] Inventors: Charles L. Hansen, Stafford; Thomas J. Soyka, Alexandria, both of Va.

[73] Assignee: The United States of America as represented by the Secretary of the Army, Washington, D.C.

[21] Appl. No.: 08/920,892

[22] Filed: Aug. 29, 1997

Related U.S. Application Data

[66] Substitute for application No. 08/454,987, May 31, 1995, abandoned.

[51] Int. Cl.[6] ..... F41G 1/36

[52] U.S. Cl. ..... 42/103; 362/110; 362/114

[58] Field of Search ..... 42/103; 362/110, 362/114

[56] References Cited

U.S. PATENT DOCUMENTS 3,739,167 6/1973 Avery ..... 240/2

4,856,218 8/1989 Reynolds, Jr. ..... 42/103

*Primary Examiner*—Charles T. Jordan

*Assistant Examiner*—Chris J. Brown

*Attorney, Agent, or Firm*—Milton W. Lee; John E. Holford; Alain L. Bashore

[57] ABSTRACT

A system and mount for releasably coupling an infrared aiming light beneath the barrel of a shotgun, including a gun barrel and an extended tubular magazine. The mount includes four clampable opposing mount surfaces, where two of the surfaces approximates a curvature of the firearm barrel and two that approximates a curvature of the extended tubular magazine. A rail mating surface and draw screw releasably couples a rail, integral with an infrared aiming light, to and below the mount surfaces. The system includes optional activation of the aiming light using a tape switch located on the hand grip of the shotgun.

2 Claims, 3 Drawing Sheets

AIMING LIGHT MOUNT AND SYSTEM FOR SHOTGUN

DESCRIPTION

Cross-Reference to Related Applications

This application is a substitute for application Ser. No. 08/454,987 filed May 31, 1995, now abandoned.

BACKGROUND OF THE INVENTION

1. Field of the Invention

The present invention generally relates to aiming light mounts and more specifically, to a mount that couples an infrared aiming light that has a rail for shotguns with extended tubular magazines.

2. Description of Prior Art

It is known in the art to attach an infrared aiming light to a firearm to assist in the aiming of the firearm at a target viewed with a night vision enhancement device. A specific example of the prior art is the use of the U. S. Army's presently fielded model AN/PAQ-4 infrared aiming light which is designed to mount on the M-16 rifle But the AN/PAQ-4 infrared aiming light is limited, in that it is designed for use only with the M-16 rifle and not other types of firearms.

Another type of firearm common to military and law enforcement is the shotgun with extended magazine. Extended tubular magazines allow the operator to exercise a much greater degree of freedom of movement in use as compared to a shotgun with a conventional stock handle. The operator of an extended magazine type shotgun though could not aim and fire, with accuracy, this type of shotgun while wearing night vision goggles. This is because the goggles could not focus on the sights on the shotgun and the target at realistic ranges, (more than a few feet) at the same time. The operator would have to either remove his goggles prior to engaging the target or engage the target with unaimed fire. Removal of the night vision goggles results in night blindness of the operator due to the contraction of the pupil from the night vision display. Unaimed firing with the night vision goggles can lead to missed targets and fratricide.

While the prior art has reported using an infrared aiming light on a rifle none have established a basis for a specific apparatus that is dedicated to the task of resolving the particular problem at hand. What is needed in this instance is a mount that allows the use of an infrared aiming light with rail on a shotgun with extended magazine, with an additional optional provision for optional activation of the infrared aiming light.

SUMMARY OF THE INVENTION

It is therefore one object of the invention to provide a mount that allows the use of an infrared aiming light with an integral rail on a shotgun.

It is a further object of the invention to provide a system including a mount and a convenient means for the optional activation of the infrared aiming light when mounted on the shotgun with extended magazine.

According to the invention, a system and mount is disclosed for releasably coupling an infrared aiming light beneath the barrel of a shotgun, including a gun barrel and an extended tubular magazine. The mount includes four clampable opposing mount surfaces, where two of the surfaces approximates a curvature of the firearm barrel and two that approximates a curvature of the extended tubular magazine. A rail mating surface and draw screw releasably couples a rail, integral with an infrared aiming light, to and below the mount surfaces. In the preferred embodiment the aiming light utilized is the Army's presently fielded model AN/PAQ-4.

The system includes optional activation of the aiming light using a tape switch located on the hand grip of the shotgun. The tape switch is electrically attached by soldering the leads of the pressure switch in parallel to the existing switch of the aiming light. A lead wire utilized must be secured to the weapon and routed in a manner such that it will not rub against moving parts of the weapon or be snagged by other objects.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
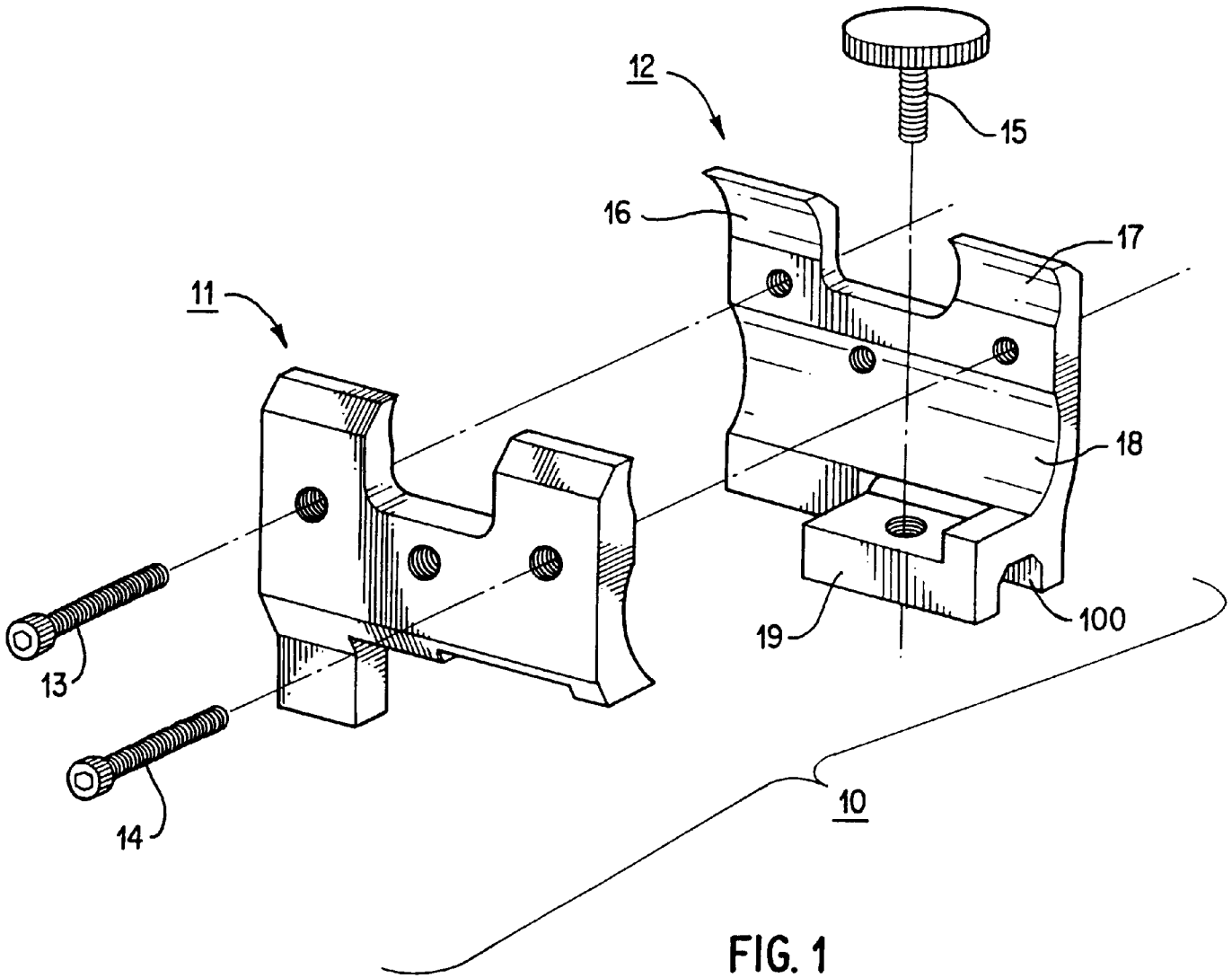
FIG. 1 is an exploded view of the mount as the present invention.

Referring now to the drawings, and more particularly to FIG. 1, there is shown an exploded view of the mount as the present invention. Mount 10 includes bracket parts 11 and 12 which are releasably coupled about the barrel and magazine of a twelve gauge shotgun of the extended magazine type by use of screws 13 and 14. Draw screw 15 is utilized to releasably couple the infrared aiming light to mount 10 from below. Each of bracket parts 11 and 12 include two separate gripping surfaces and two separate mating surfaces respectfully. Gripping surfaces 16 and 17, both of bracket part 12 (and corresponding gripping surfaces of bracket part 11) are machined with surfaces that approximate the curvature of the firearm barrel. Gripping surface 18, of bracket part 12 (and the corresponding gripping surface of bracket part 11) are machined with surfaces that approximate the curvature of the firearm magazine.

Bracket part 12 further includes a perpendicular extension 19 for receiving the threaded engagement of draw screw 15 therethrough. On the opposite surface of extension 19 is located rail mating surface 100 which is a standardized coupling configuration of use with the infrared aiming light. With draw screw 15 therethrough and extending from in between rail mating surface 100, the aiming light is releasably coupled and initially in rough alignment with the mount and thus the barrel and magazine tube of the weapon. An opening present on each of bracket parts 11 and 12 allow the head of draw screw 15 to protrude outside of mount 10 for ease of manipulation.

In the preferred embodiment, draw screw 15 in the present embodiment is machined of stainless steel, while bracket halfs 11 and 12 are composed of Aluminum 2024-T351 machined with an anodize finish. Gripping surfaces 16 and 17 have an approximate radius of curvature of 0.445 inches, and gripping surface 18 has an approximate radius of curvature of 0.508 inches. Halfs 11 and 12 are also dimensioned approximately 3.25 inches in length and 3.00 inches in height.

Figure 2:
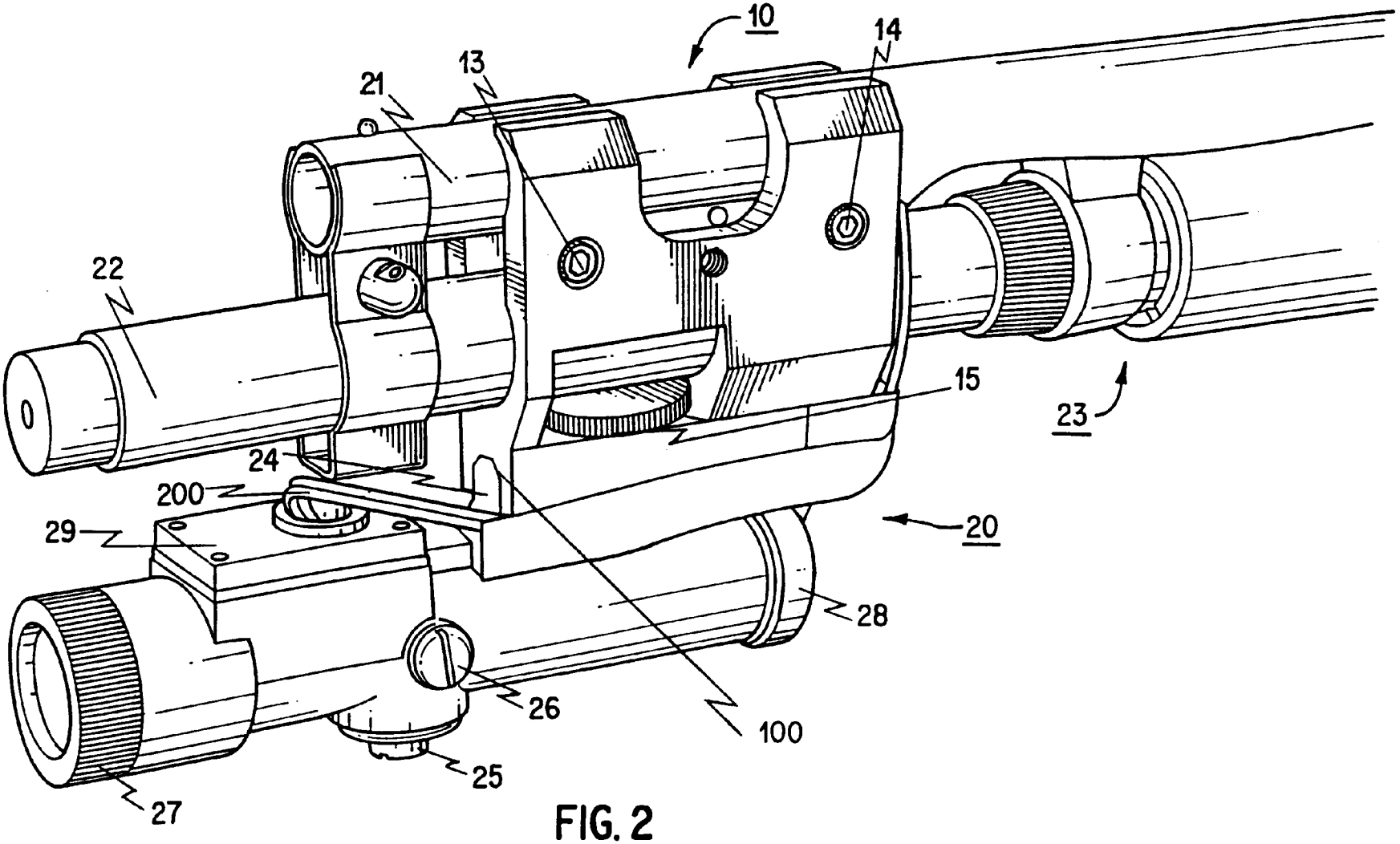
FIG. 2 is a partial perspective view of the mount utilized in mounting an AN/PAQ-4 infrared aiming light onto the end of a twelve gauge shotgun with extended magazine.

FIG. 2 is a perspective view of the mount utilized in mounting an AN/PAQ-4 infrared aiming light 20 onto the end of a twelve gauge shotgun with extended magazine. As shown in FIG. 2, mount 10 clamps around the end of the barrel 21 and around magazine tube 22, both in front of pump mechanism 23 of the weapon, such that the AN/PAQ-4 is located underneath barrel 21. Screws 13 and 14 are tightened to hold mount 10 together. Aiming light 20 includes rail 24 which releasably slides into rail mating surface 100, and with the turn down of draw screw 15 into a receptive hole on rail 24 aiming light 20 is fixedly held in place. The AN/PAQ-4 aiming light is the U.S. Army's presently fielded aiming light for use on the M-16 rifle. Boresight controls 25 and 26 allow for the Boresight adjustment of AN/PAQ-4 aiming light 20. By rotating beam divergence control 27, the infrared light beam divergence is controlled. Access to a Lithium battery compartment is made by removing access cap 28.

Figure 3:
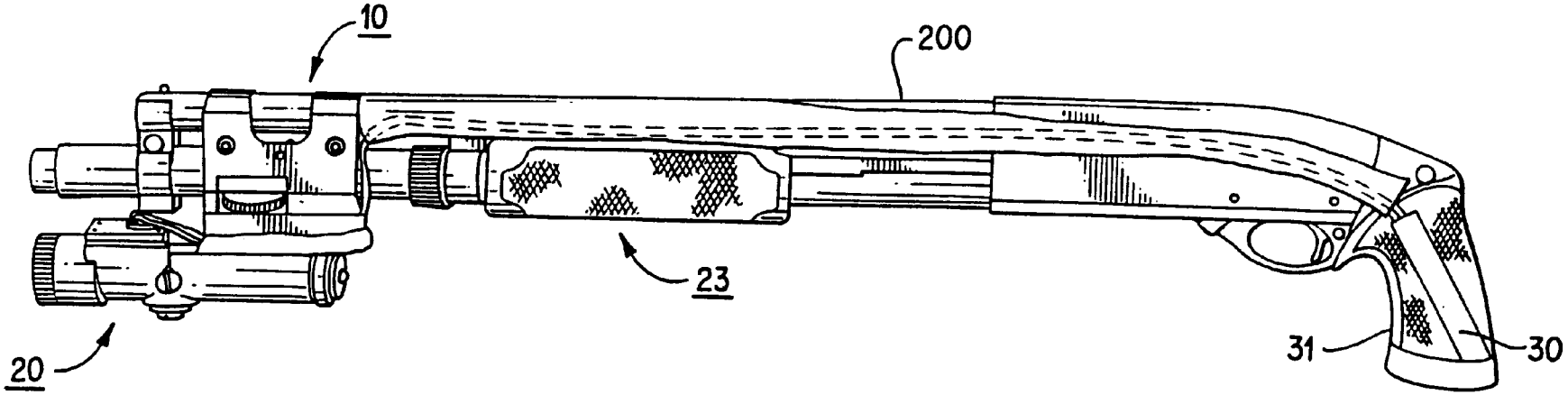
FIG. 3 is full front view of the mount showing the mounting of the AN/PAQ-4 infrared aiming light on the twelve gauge shotgun with extended magazine, shown in its entirety, including a pressure switch on the palm grip.

FIG. 3 is full front view of the mount showing the mounting of the AN/PAQ-4 infrared aiming light on the twelve gauge shotgun with extended magazine, shown in its entirety including a pressure switch 30 on palm grip 31 of the weapon. The switch used in the present embodiment is TAPE SWITCH (part# 121-BP4) made by Tape Switch Corporation of Farmingdale, N.Y., which includes a 4 inch tape switch with 30 inch lead wire. Pressure sensitive switch 30 is installed in parallel with the existing thumb switch on the AN/PAQ-4. It is electrically attached by removing cover plate 29 of FIG. 2 of the thumb switch housing on the AN/PAQ-4 and soldering the leads of the pressure switch in parallel to the existing switch. The leads may be run out in the cover plate that the thumb switch lever goes through after it is removed. Lead wire 200 (shown in phantom under tape) must be secured to the weapon and routed in a manner such that it will not rub against moving parts of the weapon or be snagged by other objects, as shown in the present embodiment of FIG. 3.

Switch 30 is mounted in an approximate position on hand grip 31 so as to be activated by the right thumb, middle, ring, or little finger. An alternate position may be selected by the user, such that the invention is not limited to the position shown in FIG. 3. The AN/PAQ-4 is activated by a pressure applied to switch 30 on the stock. The invention allows normal sighting and operation of the weapon when the AN/PAQ-4 is not in use. It is understood that any aiming light may be used for mounting by the present invention.

While this invention has been described in terms of preferred embodiment consisting of the AN/PAQ-4 aiming light and a twelve gauge shotgun, those skilled in the art will recognize that the invention can be practiced with modification within the spirit and scope of the appended claims.

Having thus described my invention, what we claim as new and desire to secure by Letters Patent is as follows:

1. A system for releasably coupling an infrared aiming light below a shotgun with further provision for optional activation of the aiming light by an operator, wherein the system includes a shotgun with extended tubular magazine, firearm barrel, and hand grip, the improvement comprising:

an infrared aiming light with integral rail;

a mounting means for releasably coupling said infrared aiming light below at said integral rail and simultaneously above to the shotgun at both the firearm barrel and extended magazine; and means for optional activation of the infrared aiming light coupled to the shotgun, whereby an operator is capable of activating the infrared aiming light, and thus aim and fire the shotgun while wearing night vision goggles.

2. The system of claim 1 wherein the means for optional activation of the aiming light is a tape switch located on the hand grip of the shotgun.

* * * * *